United States Patent [19]

Malashenko

[11] Patent Number: 4,842,000

[45] Date of Patent: Jun. 27, 1989

[54] FABRIC CLEANING

[75] Inventor: Alexander Malashenko, Dollard des Ormeaux, Canada

[73] Assignee: Valmet-Dominion Inc., Lachine, Canada

[21] Appl. No.: 155,073

[22] Filed: Feb. 11, 1988

Related U.S. Application Data

[63] Continuation-in-part of Ser. No. 865,398, May 21, 1987, abandoned.

[51] Int. Cl.[4] ..... B08B 3/04

[52] U.S. Cl. ..... 134/64 R; 134/111; 134/122 R; 68/20; 68/200

[58] Field of Search ..... 134/64 P, 64 R, 111, 134/122 P, 122 R; 68/20, 200; 118/412, 419

[56] References Cited

U.S. PATENT DOCUMENTS

| | | | |
|---|---|---|---|
| 1,998,192 | 4/1935 | Haswell | 134/122 R |
| 2,565,855 | 8/1951 | Jordan | 134/64 R |
| 3,572,352 | 3/1971 | Koopman | 134/122 R |
| 3,828,587 | 8/1974 | Holm | 68/20 |
| 4,095,442 | 6/1978 | Brugman | 68/20 |
| 4,196,019 | 4/1986 | Kohler et al. | 134/111 |
| 4,612,874 | 9/1986 | Mitter | 68/200 |
| 4,643,775 | 2/1987 | Reba et al. | 134/122 R |

FOREIGN PATENT DOCUMENTS

| | | | |
|---|---|---|---|
| 106201 | 3/1898 | Fed. Rep. of Germany . | |
| 3433933 | 6/1986 | Fed. Rep. of Germany | 68/200 |
| 751871 | 7/1980 | U.S.S.R. . | |

*Primary Examiner*—Philip R. Coe
*Assistant Examiner*—Corinne M. Reinckens
*Attorney, Agent, or Firm*—Raymond A. Eckersley

[57] ABSTRACT

The fabric cleaning system for cleaning a fabric such as the wire on a paper machine includes a cleaning station through which the fabric continuously passes. In the station cleaning fluid is directed onto a surface of the fabric, contacts the fabric to remove at least some of the debris and is collected in a collecting chamber. The dirty fluid is cleaned of debris in a cleaner such as a screen and is then returned and re-used to clean the fabric. Preferably the cleaning fluid is applied to the fabric through slots with their outlet openings adjacent the fabric and formed by tapered passages that diminish in height in the direction of the travel of the fabric. Preferably the slots extend the full width of the fabric.

19 Claims, 3 Drawing Sheets

FABRIC CLEANING

RELATED APPLICATIONS

This is a continuation-in-part of my application Ser. No. 865,398 filed May 21, 1987, and now abandoned.

FIELD OF THE INVENTION

The present invention relates to a cleaning system, more particularly the present invention relates to a cleaning system for a fabric such as a paper machine wire or the like wherein the cleaning fluid is captured, cleaned and reused. Preferably the cleaning system directs cleaning fluid through a slot which extends substantially the full width of the fabric onto the surface of the fabric as it passes closely adjacent the mouth of the slot.

BACKGROUND OF THE INVENTION

Paper machine wires and the like are currently cleaned in strips by means of a plurality of spaced jets that oscillate back and forth transversely of the wire so that each of the jets cleans a selected area of the wire. It will be apparent unless there is perfect synchronization between the wire speed and the shower oscillations parts of the wire may be cleaned significantly more than other parts in fact it is quite possible that some parts the wire may never be cleaned.

The operation of such a jet cleaning device requires that the jet strike one side of the wire driving water and fibres through the wire openings so that whether or not the opposite side of the wire is cleaned depends at least in part on fabric design. In many cases it is very important that both sides of the wire be properly cleaned, particularly in twin wire formers where both surfaces of the wire can be equally contaminated with fibres and fines from the paper stock.

Obviously when the jet of water and cleaning fluid hits the wire it is at least partly broken up into minute drops or mist, this mist floats in the vicinity of the machine and settles on machine frames, etc., and forms fibre lumps which can eventually fall onto the surface of the forming paper web and cause paper breaks. This mist obviously carries debris into the atmosphere and increases significantly the humidity and leads to general discomfort in the working environment around the machine.

In these conventional nozzle type cleaners typically about one millimeter in diameter nozzles are used which requires that the cleaning water be relatively clean to avoid plugging of the nozzles. Obviously cleaning of fresh water is expensive and therefore ignored resulting, in many cases, in the nozzles frequently becoming plugged.

Furthermore the water used to wash the wire or fabric is wasted in that it is either lost to sewer, carried out in the atmosphere around the mill or contacts and dilutes the white water system resulting in excess water in the overall system. Dilution of the white water can be extremely detrimental particularly in mills where attempts are being made to close the white water system.

The jets issuing from these nozzles are relatively high pressure and thus require a high pressure pump which is not only expensive but is troublesome in operation requiring extra maintenance. High pressure jets abrade the fabric and can in fact result in fibrillation of the fabric strands.

Another known technique for cleaning a fabric or wire is by a nip flooding shower wherein the wire traverses a roll and a shower is directed into the oncoming nip between the wire and roll. This system requires a significant amount of water all of which is either lost to sewer or dilutes the white water system. The spray is difficult to control and results in a fibre laden mist that contaminates the paper machine area and causes sheet breaks. This system is not particularly effective in cleaning the surface of the wire that contacts the roll and water which is retained in the interstices of the wire is thrown off as the wire travels around rolls contaminating the surroundings. Plugging of shower nozzles as occurs with the oscillating high pressure showers referred to above also poses a problem.

BRIEF DESCRIPTION OF PRESENT INVENTION

It is an object of the present invention to provide an improved cleaning system wherein the cleaning water may be reused and thus need not dilute the white water system.

It is a further object of the present invention to provide an improved cleaning system wherein water sprays may be substantially eliminated and the cleaning fluid applied through a substantially continuous slot opening onto and immediately adjacent the path of the travel of the fabric so that water leaving the slots immediately passes onto the fabric.

It is still a further object of the present invention to provide a fabric cleaning station wherein the water is applied continuously along the slot and the water is directed through the fabric.

In accordance with one aspect of the present invention there is provided a fabric cleaning station through which a fabric to be cleaned travels along a predetermined path. The station includes a manifold means on one side of the predetermined path. The manifold means has a plurality of outlet means through which cleansing fluid contained by the manifold means may pass. The station includes fluid communication means for communicating fluid from the outlet means of the manifold means to one side of the fabric. The fluid communication means comprises at least one slot extending from the outlet means of the manifold means and extending transverse to the direction of travel of the fabric through the station. The station includes wall means spaced from the manifold means defining the predetermined path along which the fabric travels. The at least one slot has an opening extending through the wall means for applying cleansing fluid to the one side of the fabric. The wall defines a flow constricting passage extending from the opening of each the slot and narrowing in the direction of travel of the frabric for urging the fluid through the fabric. The station further includes means to collect the fluid on the other side of the fabric, opposite to the one side to which the fluid is applied, whereby fluid issuing from the slot passes through the fabric and is collected in the means to collect.

Preferably the flow constricting passage tapers from said slot in the direction of travel of said fabric and is defined between the fabric and a surface of said wall facing said fabric. The passage tapering from a maximum depth between the fabric and the surface adjacent to the slot to a minimum depth at the end thereof remote from the slot.

In accordance with another aspect of the present invention there is provided a fabric cleaning station through which a fabric to be cleaned travels along a predetermined path. The station includes manifold means on one side of the predetermined path. The manifold means has a plurality of outlet means through which cleansing fluid contained by the manifold means may pass. The outlet means comprises a plurality of openings in the manifold. The station further includes fluid communication means for communicating fluid from the outlet means of the manifold means to one side of the fabric. The fluid communication means comprises at least one slot extending transverse to the direction of travel of the fabric through the station. The manifold openings communicate with the at least one slot. The at least one slot has a tapered portion for constricting the flow of cleansing fluid entering the slot from the manifold openings so as to evenly spread the cleansing fluid continuously along the slot at the slot opening adjacent the wall means. The station further includes wall means spaced from the manifold means defining the predetermined path along which the fabric travels. The at least one slot has an opening extending through the wall means for applying cleansing fluid to the one side of the fabric. The station also includes means to collect the fluid on the other side of the fabric, opposite to the one side to which the fluid is applied, whereby fluid issuing from the slot passes through the fabric and is collected in the means to collect.

In some cases it may be preferred to have a pair of manifolds one positioned, on each side of the fabric, to direct the cleaning fluid onto opposite sides of the fabric in sequence and to collect the fluid at opposite sides of the fabric.

BRIEF DESCRIPTION OF THE DRAWINGS

Further features objects and advantages will be evident from the following detailed description of the preferred embodiments of the present invention taken in conjunction with the accompanying drawings in which.

DESCRIPTION OF PREFERRED EMBODIMENT

Figure 1:
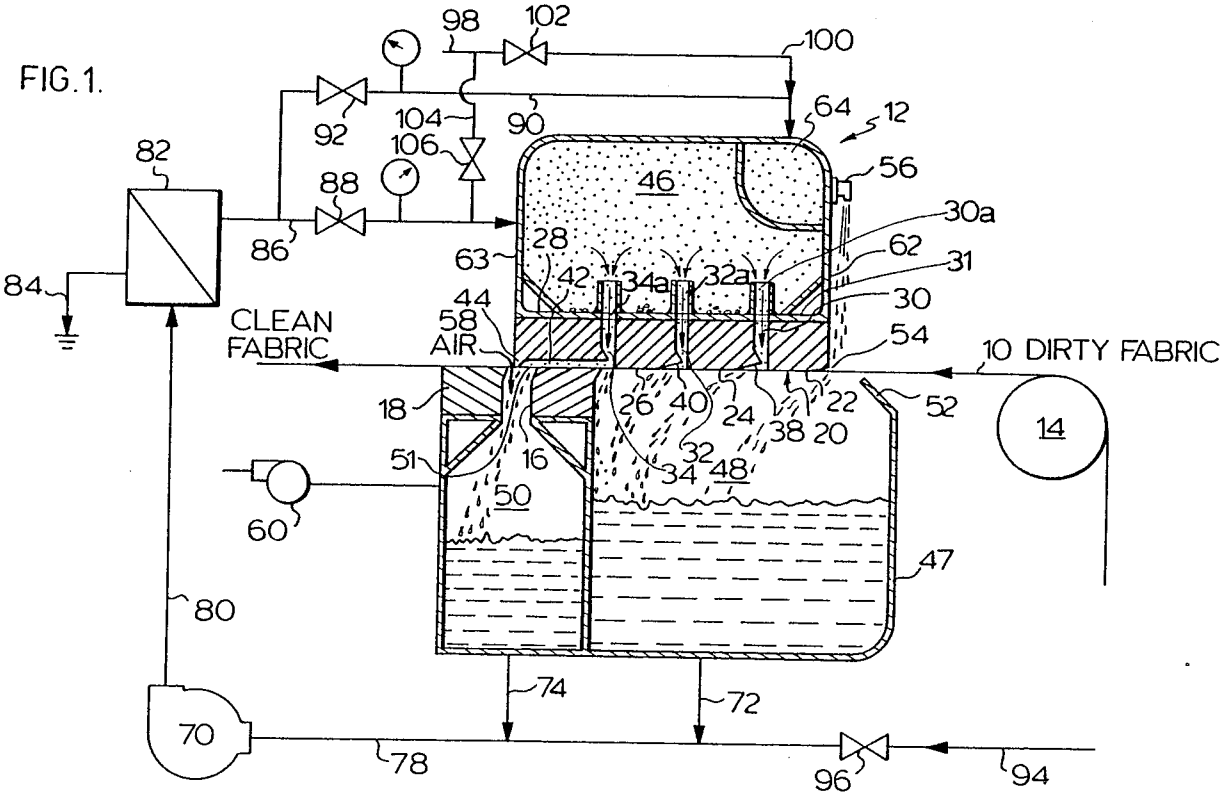
FIG. 1 is a sectioned view through a cleaning station diagrammatically illustrating the cleaning station as well as the recirculation system.

As shown in FIG. 1 a dirty fabric 10 enters the cleaning station 12 from the right and travels to the left in all the Figures. The fabric passes through the cleaning station 12 under tension and is directed into close proximity with the surface of wall 20 via the roll 14 and supports 16 and 18. The wall 20 is formed in the illustrated arrangement by a plurality of discrete surface sections 22, 24, 26 and 28 separated by fluid applying slots 30, 32 and 34. Lead in section 22 in the arrangement illustrated in FIG. 1 extends from the beginning of the surface of wall 20 to the first slot 30 and the sections 24, 26, and 28 is preceded by slot 30, 32, and 34 respectively. The slot 30, 32 and 34 each extend transversely to the path of the fabric 10 and each preferably extends the full width of the fabric 10. Fresh cleaning fluid is applied to the fabric from these slots 30, 32 and 34 across the full width of the fabric.

Figure 4:
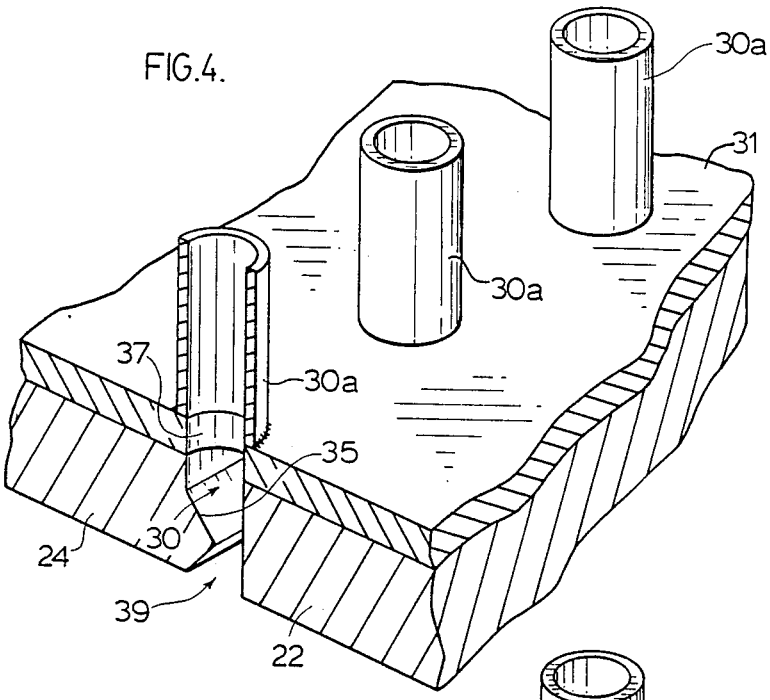
FIG. 4 is a partial perspective view showing the outlet openings of the manifold and the manner in which these outlet openings are in fluid flow communication with the slot passing through the wall above the fabric.
Figure 5:
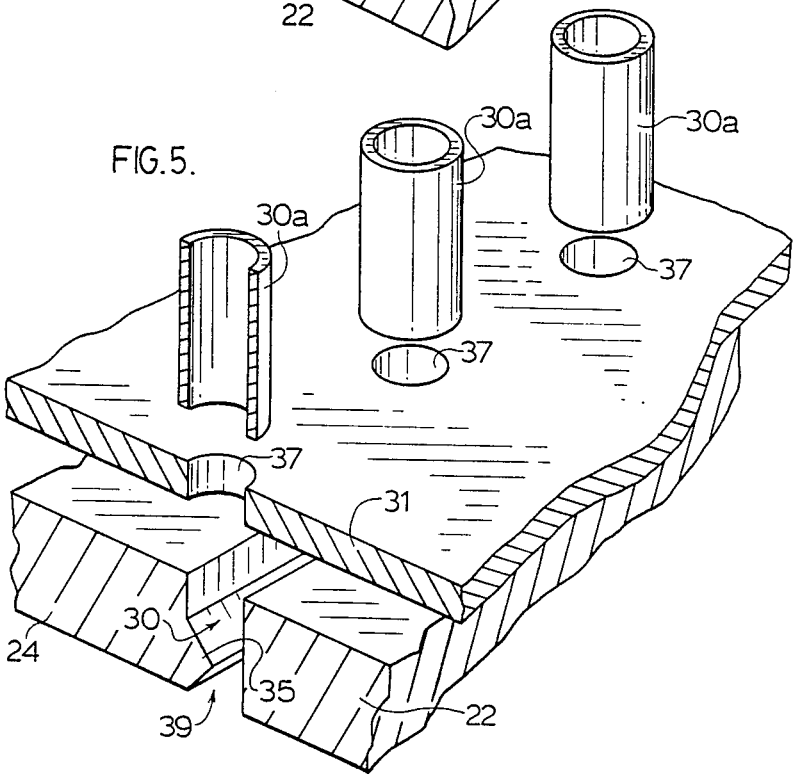
FIG. 5 is an exploded view similar to the view shown in FIG. 4.

Referring to FIGS. 4 and 5 it is seen that the outlet means of the manifold 46 comprises a linear series of pipes 30*a* that extend through a drilled plate 31. The drilled plate is secured to the top of wall 22, 24, and 26. As a result, the manifold which houses the cleansing fluid does not have a continuous slot in its floor. Below each of the series of pipe 30*a*, 32*a*, and 34*a* of the of the manifold there extends a the respective slot 30, 32, or 34. From these Figures it can be seen that each of the slots 30, 32, and 34 has a tapered portion 35 for constricting the flow of cleansing fluid entering the slot from the pipes through openings 37. The purpose of the tapering portion 35 in the slot 30 is to evenly spread the fluid received from the manifold 46 along the entire length of the slot at the opening 39 of the slot adjacent the wall or walls 22, 24. It should be understood that this tapering portion should result in the slot having a narrow part whose area is less than or equal to the cumulative area of the manifold openings 37 opening into the slot. Such a limitation will result in the water spreading along the narrow portion of the slot.

It will be noted that each of the sections 24 and 26 define one side and the fabric defines the opposite side of tapering passage or gap 38 and 40 respectively, each having its greatest depth measured perpendicular to the fabric adjacent the outlet of its respective slot 30 and 32 and its minimum depth at the end thereof remote from its respective slot 30 and 32. These tapered passages 38 and 40 act as flow constricting passages that tend to direct or urge the cleaning fluids through the dirty fabric.

Modified leading surface 28 which leads the slot 34 in the direction of travel of the fabric 10 defines with the fabric 10 a passage 42 overlying and extending substantially the full length of the support 16. Fluid ejected through the slot 34 and trapped between the fabric 10 and surface 28 passes over the support 16 through passage 42 with the fabric and then is directed through the fabric via a deflecting wall section 44 that blocks off the passage 42 and approaches very closely adjacent the upper surface of fabric 10 so that the fluid travelling through passage 42 is deflected through the fabric 10 and into the chamber 50 through passage 51 defined between the front of deflection wall 44 and rear edge of support 16.

Each of the slots 30, 32 and 34 communicates with a manifold or reservoir 46 which provides a source of cleaning fluid.

Between the supports 16 and the bottom front wall 47 is a first chamber or container 48 and between the supports 16 and 18 is a second chamber 50. It will be apparent that the chambers 48 and 50 are located on the opposite side of the fabric 10 to the manifold 46 and that the cleaning fluid ejected through the nozzles or outlet of slots 30, 32 and 34 onto the surface of the fabric 10 passes through the fabric 10 washing samme and is received within the chambers 48 and 50.

The surface section 28 of the wall 20 terminates before the front edge of the support 18 to provide a passage or opening 58 to direct air through the fabric 10 and into the chamber 50. Chamber 50 may be maintained under negative pressure via suitable means such as a blower indicated at 60.

A lubricating shower 56 sprays cleaning fluid down the front wall of the manifold 46 to pass through the fabric 10 and into the chamber 48 through passage 54 formed between the turned in lip 52 of the top of wall 47 and the front wall 62 (i.e. the front end of surface 22).

The nozzle 56 extends substantially the full width of the fabric 10 and showers a fluid down along the front wall 62 of the manifold 46 to keep that front wall clean. The cleaing fluid used in the shower 56 may be of a different composition to that used in the various slots 30, 32 and 34 and thus a separate chamber or manifold 64 is used to supply fluid into the nozzle of shower 56.

This shower 56 is not absolutely essential and may, if desired, be eliminated completely.

The cleaning fluid which normally will be water is recirculated via a pump 70 that draws the cleaning fluid from the chambers 48 and 50 via lines 72 and 74 into the main line 78 leading to the pump 70. Cleaning fluid from the pump 70 passes via line 80 to a filter system 82 with the rejects from the system 82 being either sewered or sent back to the white water system as indicated by the arrow 84. The cleaning fluid from the filter passes via line 86 directly into the manifold 46. Flow is controlled by a suitable valve 88. If a lubricating shower equivalent to the shower 56 is used and if a separate supply of fluid is provided for example by the use of the manifold 64 fluid is returned to the manifold 64 via line 90 with flow therethrough being controlled via valve 92.

Fresh water enters the system via line 94 under the control of the valve 96.

In some cases it will be desired to add chemicals either to fluid issuing from nozzle 56 or supplied to the manifold 46 or both. In such cases cleaning chemical is maybe provided via line 98 and supplied to the reservoir or manifold 64 via line 100 under control of the valve 102 and/or maybe directed to the manifold 46 via line 104 under the control of valve 106.

The arrangement shown in FIG. 1 operates as follows:

Fresh cleaning fluid in the manifold 46 passes through the pipes 30*a*, 32*a*, and 34*a* and into the slots 30, 32 and 34 and is directed against one surface (the top surface) of the dirty fabric 10. It should be understood that the pipes extend above the floor of the manifold 46 so that any debris in the manifold settles to the floor and is not transferred to the fabric. The tapering portion 35 in the slots 30, 32, and 34 acts to spread the fluid evenly along the slots adjacent the fabric. The fluid issuing from the nozzles or slots 30 and 32 is forced through the fabric 10 via the wedge shaped outlet passages 38 and 40 formed in the surfaces 24 and 26 is collected in chamber 48. Some of the cleaning fluid ejected through the nozzle 34 passes directly through the fabric 10 into collected in the chamber 48. Cleaning fluid from nozzle 34 remaining in or above the fabric passes via the passage 42 over the support 16 and is directed by the deflecting section 44 of surface 28 through passage 51 into the chamber 50. Preferably the chamber 50 will be maintained under a negative pressure via the blower 60 so that air will be drawn in through the passage 58 to drive further water from the fabric and dry the fabric 10. Fluid from the chambers 48 and 50 discharges via lines 72 and 74 into the main line 78 and is moved via the pump 70 through line 80 to the filter 82. Debris separated in the filter system 82 is carried in line 84 either to sewer or returned to the white water system (not shown) and the cleaned fluid then passes via line 86 into the manifold 46 to be reused and passed through the slots 30, 32 and 34 onto a following portion of the fabric 10 and line 90 to manifold 64.

When the fluid to be applied via the shower 56 is different from the fluid applied via the slots 30, 32 and 34 suitable amounts of cleaning chemical may be added to the flow into the manifold 64 via the line 100.

As above described if desired suitable cleaning chemicals may also be added into the washing fluid in the manifold 46 via line 104.

When the lubricating shower 56 is operating fluid from the shower passes down the front wall 62 of the manifold 46 onto the top surface of the fabric 10 and passes through the fabric 10 to the reservoir 48 through the gap 54 between the lip 52 and the front wall 62 and surface 22.

The arrangement permits recirculation of the cleaning fluid and thus eliminates any problem of contamination or dilution of the white water by washing fluid. The passage of air through the fabric 10 and into the chamber 50 tends to dry the fabric and thereby improve its condition when it is returned to contact the paper stock.

Figure 2:
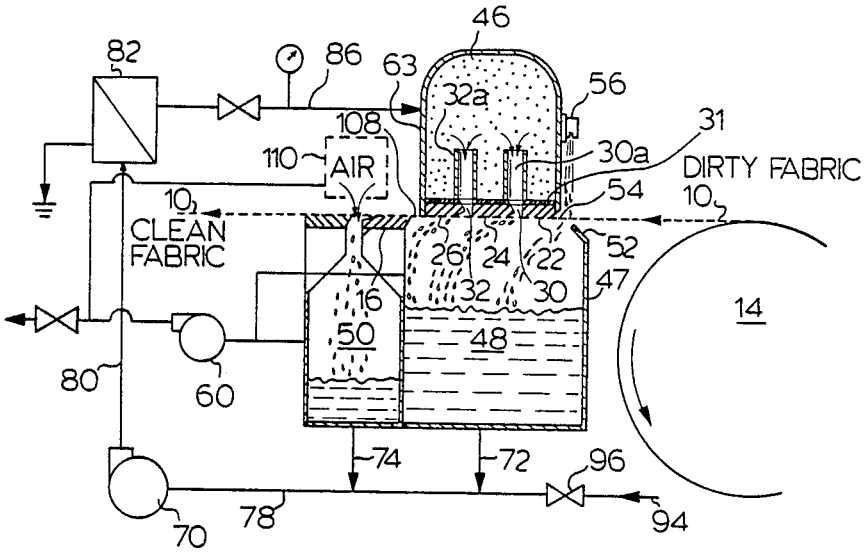
FIG. 2 is a view similar to FIG. 1 showing a modified station.

The arrangement shown in FIG. 2 is quite similar to that shown in FIG. 1 however in this case with the system illustrated no separate lubricating chemical is being used in the lubricating shower 56 thus the cleaning fluid that is used in the slots 30, 32 and 34 is used in the shower 56. In the arrangement illustrated in FIG. 2 only 2 slots i.e. those equivalent to 30 and 32 have been provided each of which will have its leading surfaces 24 and 26 with the wedge shaped passages 38 and 40 respectively provided therein. Basically the difference between the FIG. 2 embodiment and that in FIG. 1 is that only two slots 30 and 32 have been provided and passage 42 has been eliminated.

An opening 108 is provided between the rear wall 63 of the manifold 46 i.e. the rear end of surface 26 and the adjacent edge of the support 16 so that air may pass through the fabric 10 into the chamber 48. Air is drawn through opening 108 and chamber 48 is maintained at below atmospheric pressure by blower 60. The remainder of the system is essentially the same as FIG. 1. If desired instead of air being simply drawn through the fabric 10 into the chamber 50 via a negative pressure produced by the pump 60 the air under pressure for example from the pump 60 may be directed to a chamber 110 as shown in dotted lines to indicate its optionality and blown positively through the fabric 10 and into the chamber 50. Air may be similarly blown into chamber 48 through opening 108.

If desired the added fresh water in line 94 may contain some cleaning chemical.

Figure 3:
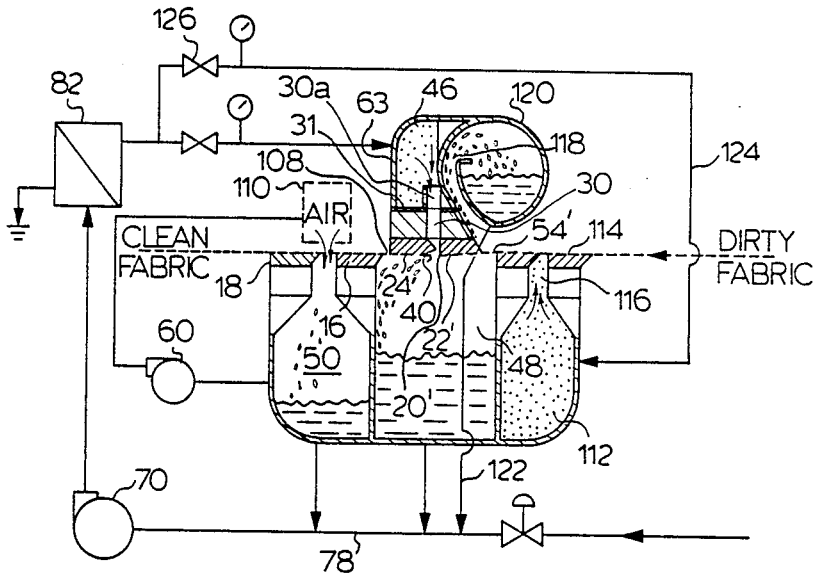
FIG. 3 is a similar view illustrating yet another cleaning station.

The arrangement shown in FIG. 3 is similar to that shown in the other Figures however in this arrangement only a single slot 30 is provided above the wire. The fabric 10 is deflected via the leading surface 22' and passes along the surface 24' which maybe provided with the same wedge shaped passage 40 leading from the slot 30. The surfaces 22 and 24 combine to form a convex curved surface of wall 20 around which the fabric 10 passes.

In the arrangement of FIG. 3 a bottom manifold or reservoir 112 is provided for supplying fluid to a nozzle or slot 116 formed in a support surface 114. The surface 114 may be flat or convexly curved and the slot 116 may be similar to the nozzle or slot 30. Fluid issuing from the nozzle or slot 116 from manifold 112 passes through the fabric 10 and is directed by auto slice 118 into a receiving chamber 102. Fluid from chamber 120 passes via line 122 to the main return line 78 to the pump 70.

A suitable gap 54' is provided between the support 114 and the surface 22' so that some of the cleaning fluid passing from slot 116 into the fabric 10 may pass through the slot 54 into the chamber 48. In this arrangement fluid from chamber 120 passes via line 122 to return line 78 for pump 70 and fresh cleaning fluid from the filter system 82 is carried by line 124 under control of valve 126 into the reservoir or manifold 112. The support surface 114 and nozzle or slot 116 etc, may be used in the FIG. 1 or 2 embodiments.

Embodiments in FIGS. 2 and 3 operate in the same manner as described above with respect to the embodiment of FIG. 1 however in the FIG. 2 embodiment only a pair of slots 30 and 32 have been provided and air may optionally be blown into the chamber 118 and/or 50 (as could have been done with the FIG. 1 embodiment). In FIG. 3 liquid is directed to opposite sides of the fabric via the slots 116 and 30 respectively so that cleaning fluid passes first to one direction through the fabric and then in another direction through the fabric.

Throughout the disclosure term fabric has been used which is intended to include forming wires as used in fourdrinier machines, twin wire formers or any other type of machines for manufacture of paper or pulp sheet. The term is also intended to include felts such as the press or drier felts used in manufacture of paper.

Modifications will be evident to those skilled in the art without departing from the spirit of the invention as defined in the appended claims.

I claim as follows:

1. A fabric cleaning station through which a fabric to be cleaned travels along a predetermined path, said station including:

manifold means on one side of said predetermined path, said manifold means having a plurality of outlet means through which cleansing fluid contained by said manifold means may pass;

fluid communication means for communicating fluid from the outlet means of said manifold means to one side of said fabric comprising at least one slot extending from the outlet means of said manifold means and extending transverse to the direction of travel of said fabric through said station;

wall means spaced from said manifold means defining said predetermined path along which said fabric travels, said at least one slot having an opening extending through said wall means for applying cleansing fluid to the one side of said fabric, said wall defining a flow constricting passage extending from the opening of each said slot and narrowing in the direction of travel of said fabric for urging said fluid through said fabric; and, means to collect said fluid on the other side of said fabric, opposite to the one side to which said fluid is applied, whereby fluid issuing from said slot passes through said fabric and is collected in said means to collect.

2. The fabric cleaning station of claim 1 wherein said flow constricting passage comprises a tapering portion of said wall that tapers in the direction of travel of said fabric from a maximum depth between said fabric and said surface of said wall adjacent the opening of said slot to a minimum depth at its end remote from said slot.

3. The fabric cleaning station of claim 1 wherein said outlet means comprises a plurality of openings in said manifold which manifold openings communicate with said at least one slot, said at least one slot having a tapered portion for constricting the flow of cleansing fluid entering the slot from the manifold openings so as to evenly spread the cleansing fluid continuously along said slot at the opening of the slot adjacent the wall means.

4. The fabric cleaning station of claim 2 wherein the tapered portion of said slot is located adjacent the slot opening.

5. The fabric cleaning station of claim 2 wherein the outlet means further include a plurality of conduits which extend above the manifold openings.

6. A station as defined in claim 1 wherein there are a plurality of slots each with an associated flow constricting passage.

7. A station as defined in claim 1 wherein each said slot extends the full width of said fabric.

8. A station as defined in claim 1 further comprising a second manifold means on the opposite side of said path to said one side, further slot means opening from said second manifold means directing washing fluid onto a surface of said fabric opposite said one surface of said fabric.

9. A station as defined in claim 1 wherein said means to collect includes a chamber means on the opposite side of said fabric from said slot the fluid from which is to be collected in said chamber means.

10. A system as defined in claim 1 further comprising a further chamber means following said means for applying, means to cause air flow through said fabric and into said further chamber means to drive fluid from said fabric into said further chamber.

11. A fabric cleaning station through which a fabric to be cleaned travels along a predetermined path, said station including:

manifold means on one side of said predetermined path, said manifold means having a plurality of outlet means through which cleansing fluid contained by said manifold means may pass, said outlet means comprising a plurality of spaced apart openings in a floor of said manifold and a plurality of conduits each of which extend above a corresponding one of the openings;

fluid communication means for communicating fluid from the outlet means of said manifold means to one side of said fabric comprising at least one slot extending transverse to the direction of travel of said fabric through said station, the manifold openings and corresponding conduits being positioned in alignment above the at least one slot to communicate fluid from the manifold through the conduits and corresponding openings into said at least one slot, said at least one slot having a tapered portion for constricting the flow of cleansing fluid entering the slot from the spaced apart openings so as to evenly spread the cleansing fluid continuously along said slot at the slot opening adjacent the wall means;

wall means spaced from said manifold means defining said predetermined path along which said fabric travels, said at least one slot having an opening extending through said wall means for applying cleansing fluid to the one side of said fabric, and, means to collect said fluid on the other side of said fabric, opposite to the one side to which said fluid is applied, whereby fluid issuing from said slot passes through said fabric and is collected in said means to collect.

12. The fabric cleaning station of claim 11 wherein the tapered portion of said slot is located adjacent the slot opening.

13. The fabric cleaning station of claim 11 wherein said wall defines a flow constricting passage extending from the opening of each said slot and narrowing in the direction of travel of said fabric for urging said fluid through said fabric.

14. The fabric cleaning station of claim 11 wherein flow constricting passage comprises a tapering portion of said wall that tapers in the direction of travel of said fabric from a maximum depth between said fabric and said surface of said wall adjacent the opening of said slot to a minimum depth at its end remote from said slot.

15. A station as defined in claim 11 wherein there are a plurality of slots.

16. A station as defined in claim 11 wherein each said slot extends the full width of said fabric.

17. A station as defined in claim 11 further comprising a second manifold means on the opposite side of said path to said one side, further slot means opening from said second manifold means directing washing fluid onto a surface of said fabric opposite said one surface of said fabric.

18. A station as defined in claim 11 wherein said means to collect includes a chamber means on the opposite side of said fabric from said slot the fluid from which is to be collected in said chamber means.

19. A system as defined in claim 11 further comprising a further chamber means following said means for applying, means to cause air flow through said fabric and into said further chamber means to drive fluid from said fabric into said further chamber.

* * * * *